US006727055B1

(12) United States Patent
Adin et al.

(10) Patent No.: US 6,727,055 B1
(45) Date of Patent: Apr. 27, 2004

(54) HIGH BROMIDE CUBIC GRAIN EMULSIONS

(75) Inventors: Anthony Adin, Rochester, NY (US); Richard E. Beal, Rochester, NY (US); Anthony D. Gingello, Rochester, NY (US); Stephen A. Hershey, Victor, NY (US); John D. Mee, Rochester, NY (US); Myra T. Olm, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/299,475

(22) Filed: Nov. 19, 2002

(51) Int. Cl.[7] ..... G03C 1/005; G03C 1/494

(52) U.S. Cl. ..... 430/567; 430/599; 430/604; 430/605

(58) Field of Search ..... 430/567, 599, 430/604, 605

(56) References Cited

U.S. PATENT DOCUMENTS

| | | | | |
|---|---|---|---|---|
| 4,937,180 A | | 6/1990 | Marchetti et al. | |
| 4,945,035 A | | 7/1990 | Keevert, Jr. et al. | |
| 5,494,789 A | | 2/1996 | Daubendiek et al. | |
| 5,503,970 A | | 4/1996 | Olm et al. | |
| 5,503,971 A | | 4/1996 | Daubendiek et al. | |
| 5,518,872 A | * | 5/1996 | King et al. | 430/567 |
| 5,558,981 A | | 9/1996 | Bayley | |
| 5,631,126 A | * | 5/1997 | Daubendiek et al. | 430/567 |
| 5,902,721 A | * | 5/1999 | Becher et al. | 430/605 |
| 5,998,083 A | | 12/1999 | Verbeeck et al. | |
| 6,277,552 B1 | | 8/2001 | Elst et al. | |

OTHER PUBLICATIONS

Co–pending, commonly assigned, concurrently filed, U.S. patent application Ser. No. 10/299,936, titled "Radiographic Film With Improved Signal Detection For Mammography", of Adin et al (Kodak Docket 84261JLT) 10/440,750 430/139.

Co–pending, commonly assigned, concurrently filed, U.S. patent application Ser. No. 10/299,237 titled "Radiographic Film For Mammography With Improved Processability", of Adin et al (Kodak Docket 84262JLT) 10/440,950 430/139.

Co–pending, commonly assigned, concurrently filed, U.S. patent application Ser. No. 10/299,765, titled "Mammography Film And Imaging Assembly For Use With Rhodium Or Tungsten Anodes", of Dickerson et al (Kodak Docket 84710JLT) 378/173.

* cited by examiner

*Primary Examiner*—Geraldine Letscher
(74) *Attorney, Agent, or Firm*—Andrew J. Anderson

(57) ABSTRACT

A radiation-sensitive emulsion is disclosed comprised of cubic silver iodochlorobromide grains comprising 0.25 to about 1.5 mol % iodide, 1 to about 25 mol % chloride, and from about 73.5 to 98.75 mol % bromide, each based on total silver in the emulsion, wherein the grains have an average equivalent circular diameter of greater than 0.6 micrometers and contain from $10^{-7}$ to $10^{-3}$ mole per silver mole of a metal ion coordination complex dopant of Formula (I) in an internal region of the grains formed after 10 percent and before 95 percent of the total grain silver has been precipitated:

$$[ML_6]^n \qquad (I)$$

wherein n is zero, −1, −2, −3 or −4, M is a filled frontier orbital polyvalent metal ion, other than iridium, and $L_6$ represents bridging ligands which can be independently selected, provided that at least four of the ligands are anionic ligands, and at least one of the ligands is a cyano ligand or a ligand more electronegative than a cyano ligand. Doping of relatively large grain silver iodochlorobromide cubic grain emulsions in accordance with the invention provides optimized speed, contrast and low intensity efficiency.

21 Claims, No Drawings

HIGH BROMIDE CUBIC GRAIN EMULSIONS

FIELD OF THE INVENTION

This invention is directed to radiation sensitive high bromide silver halide cubic grain photographic emulsions. It particularly relates to high bromide silver iodochlorobromide cubic grain emulsions doped with a metal ion coordination complex.

DEFINITION OF TERMS

In referring to grains and emulsions containing two or more halides, the halides are named in order of ascending concentrations.

The term "high bromide" in referring to silver halide grains and emulsions indicate greater than 50 mole percent bromide, based on total silver.

The term "equivalent circular diameter" or "ECD" indicates the diameter of a circle having an area equal to the projected area of a grain or particle.

The term "size" in referring to grains and particles, unless otherwise described, indicates ECD.

The term "regular grain" refers to a silver halide grain that is internally free of stacking faults, which include twin planes and screw dislocations.

The term "cubic grain" is employed to indicate a regular grain that is bounded by six {100} crystal faces. Typically the corners and edges of the grains show some rounding due to ripening, but no identifiable crystal faces other than the six {100} crystal faces. The six {100} crystal faces form three pairs of parallel {100} crystal faces that are equidistantly spaced.

The term "cubical grain" is employed to indicate grains that are at least in part bounded by {100} crystal faces satisfying the relative orientation and spacing of cubic grains. That is, three pairs of parallel {100} crystal faces are equidistantly spaced. Cubical grains include both cubic grains and grains that have one or more additional identifiable crystal faces. For example, tetradecahedral grains having six {100} and eight {111} crystal faces are a common form of cubical grains.

The term "roundness coefficient" (hereinafter assigned the symbol "n") and the term "roundness index" (hereinafter assigned the symbol "Q") are measures of the degree to which silver halide grain comers are rounded as defined by Mehta et al. in U.S. Pat. No. 6,048,683. "n" is chosen to satisfy the formula $x^n+y^n=R^n$, where R is any vector extending from the center of a {100} crystal face of a grain to the projected peripheral edge of the grain viewed normal to the {100} crystal face, x is an X axis coordinate of R, y is a Y axis coordinate of R, and X and Y are mutually perpendicular axes in the plane of the {100} crystal face. For a circle, the roundness coefficient is 2, while for a square the roundness coefficient is increased to infinity. For convenience, roundness index Q is defined as being equal to 2/n. Thus, the Q of a square is zero, while that for a circle is 1. The degree to which regular silver halide grains having {100} crystal faces exhibit comer rounding is determined by looking at the projected area of a grain in a photomicrograph viewed normal to a {100} crystal face. The value of n that most closely matches the peripheral boundary of the {100} grain face is the roundness coefficient of the grain. From measurement of a representative number of grains, an average roundness coefficient n and roundness index Q can be determined for an emulsion.

The term "central portion" or "core" in referring to silver halide grains refers to an interior portion of the grain structure that is first precipitated relative to a later precipitated portion.

The term "shell" in referring to silver halide grains refers to an exterior portion of the silver halide grain which is precipitated on a central portion.

The term "dopant" is employed to indicate any material within the rock salt face centered cubic crystal lattice structure of a silver halide grain other than silver ion or halide ion.

The term "dopant band" is employed to indicate the portion of the grain formed during the time that dopant was introduced to the grain during precipitation process.

The term "log E" is the logarithm of exposure in lux-seconds. Photographic speed is reported in relative log units and therefore referred to as relative log speed. 1.0 relative log speed unit is equal to 0.01 log E.

The term "contrast" or "γ" is employed to indicate the slope of a line drawn from stated density points on the characteristic curve.

The term "rapid access processing" and "rapid access processor" are employed to indicate the capability of providing dry-to-dry processing in 90 seconds or less. The term "dry-to-dry" is used to indicate the processing cycle that occurs between the time a dry, imagewise exposed element enters a processor to the time it emerges, developed, fixed and dry The term "reciprocity law failure" refers to the variation in response of an emulsion to a fixed light exposure due to variation in the specific exposure time.

*Research Disclosure* is published by Kenneth Mason Publications, Ltd., Dudley House, 12 North St., Emsworth, Hampshire P010 7DQ, England.

All references to the periodic table of elements periods and groups 2 0 in discussing elements are based on the Periodic Table of Elements as adopted by the American Chemical Society and published in the *Chemical and Engineering News*, Feb. 4, 1985, p. 26. The term "Group VIII" is used to generically describe elements in groups 8, 9 and 10.

BACKGROUND OF THE INVENTION

Radiation sensitive silver halide emulsions are used in conventional photograph elements and other imaging systems to record imagewise exposures, where the silver halide emulsions employed are selected or designed to provide desired performance attributes. The use of dopants in silver halide grains to modify photographic performance is well know in the photographic art, as generally illustrated, e.g., by *Research Disclosure*, Item 38957, I. Emulsion grains and their preparation, D. Grain modifying conditions and adjustments, paragraphs (3)–(5). Photographic performance attributes known to be affected by dopants include sensitivity, reciprocity failure, and contrast.

The contrast of photographic elements containing silver halide emulsions can generally be increased by incorporating into the silver halide grains a dopant capable of creating deep electron trapping sites, such as illustrated by R. S. Eachus, R. E. Graves and M. T. Olm *J Chem. Phys.*, Vol. 69, pp. 4580–7 (1978) and *Physica Status Solidi A*, Vol. 57, 429–37 (1980) and R. S. Eachus and M. T. *Olm Annu. Rep. Prog. Chem. Sect. C. Phys. Chem.*, Vol. 83, 3, pp. 3–48 (1986). While deep electron trapping dopants are effective at increasing contrast of photographic elements, significant speed losses in such elements are also generally associated with their use.

Using empirical techniques the art has over the years identified many dopants capable of increasing photographic speed. Keevert et al U.S. Pat. No. 4,945,035, e.g., was the first to teach the incorporation of a hexacoordination complex containing a transition metal and cyano ligands as a dopant in high chloride grains to provide increased sensitivity. Marchetti et al. U. S. Pat. No. 4,937,180 teaches the incorporation of hexacoordination complex containing rhenium, ruthenium, osmium, or iridium and cyano ligands in high bromide grains optionally containing iodide. Scientific investigations have gradually established that one general class of speed increasing dopants share the capability of providing shallow electron trapping sites. Olm et al U.S. Pat. No. 5,503,970 and Daubendiek et al U.S. Pat. Nos. 5,494,789 and 5,503,971, here incorporated by reference, as well as *Research Disclosure*, Vol. 367, November 1994, Item 36736, were the first to set out comprehensive criteria for a dopant to have the capability of providing shallow electron trapping sites.

Doping with iridium is commonly performed to reduce reciprocity law failure in silver halide emulsions. According to the photographic law of reciprocity, a photographic element should produce the same image with the same exposure, even though exposure intensity and time are varied. For example, an exposure for 1 second at a selected intensity should produce exactly the same result as an exposure of 2 seconds at half the selected intensity. When photographic performance is noted to diverge from the reciprocity law, this is known as reciprocity failure. Specific iridium dopants include hexachloride complexes such as those illustrated by Bell U.S. Pat. Nos. 5,474,888, 5,470,771 and 5,500,335 and McIntyre et al 5,597,686.

The use of dopant coordination complexes containing organic ligands is disclosed by Olm et al U.S. Pat. No. 5,360,712, Olm et al U.S. Pat. No. 5,457,021 and Kuromoto et al U.S. Pat. No. 5,462,849.

It is desirable that some photographic elements exhibit relatively high photographic contrast. In the field of Graphic Arts, e.g., high contrast is used to produce well defined dots of different sizes to create halftone images. Medical diagnostic radiographic imaging films, and in particular mammographic films, also may require relatively high contrast, and additionally higher speed than graphic arts films. The use of radiation-sensitive silver halide emulsions for medical diagnostic imaging can be traced to Roentgen's discovery of X-radiation by the inadvertent exposure of a silver halide film. Eastman Kodak Company then introduced its first product specifically that was intended to be exposed by X-radiation in 1913. In conventional medical diagnostic imaging the object is to obtain an image of a patient's internal anatomy with as little X-radiation exposure as possible. The fastest imaging speeds are realized by mounting a dual-coated radiographic element between a pair of fluorescent intensifying screens for imagewise exposure. About 5% or less of the exposing X-radiation passing through the patient is adsorbed directly by the latent image forming silver halide emulsion layers within the dual-coated radiographic element. Most of the X-radiation that participates in image formation is absorbed by phosphor particles within the fluorescent screens. This stimulates light emission that is more readily absorbed by the silver halide emulsion layers of the radiographic element. Relatively large, cubic high bromide emulsions are often preferred for use in such photographic elements in view of their ready availability in a wide range of relatively monodisperse grain sizes and associated speed and high contrast responses. Inclusion of minor percentages of iodide and chloride in such high bromide cubic grain emulsions may also be desirable to further improve sensitivity, image tone, and processing attributes. It may further be desirable to reduce low intensity reciprocity failure (LIRF) in photographic elements, to advantageously allow imagewise exposures to be made with lower intensity exposures.

Accordingly, it would be desirable to provide a high bromide silver iodochlorobromide cubic grain emulsion which exhibits relatively high photographic sensitivity, relatively high contrast, and decreased reciprocity failure.

SUMMARY OF THE INVENTION

In one aspect this invention is directed towards a radiation-sensitive emulsion comprised of cubic silver iodochlorobromide grains comprising 0.25 to about 1.5 mol % iodide, 1 to about 25 mol % chloride, and from about 73.5 to 98.75 mol % bromide, each based on total silver in the emulsion, wherein the grains have an average equivalent circular diameter of greater than 0.6 micrometers and contain from $10^{-7}$ to $10^{-3}$ mole per silver mole of a metal ion coordination complex dopant of Formula (I) in an internal region of the grains formed after 10 percent and before 95 percent of the total grain silver has been precipitated:

$$[ML_6]^n \quad \text{(I)}$$

wherein n is zero, −1, −2, −3 or −4; M is a filled frontier orbital polyvalent metal ion, other than iridium; and $L_6$ represents bridging ligands which can be independently selected, provided that at least four of the ligands are anionic ligands, and at least one of the ligands is a cyano ligand or a ligand more electronegative than a cyano ligand.

In a second aspect, this invention is directed towards a photographic element, and especially a radiographic recording element, comprising a support and at least one light sensitive silver halide emulsion layer comprising silver halide grains as described above.

It has been discovered quite surprisingly that doping of relatively large grain silver iodochlorobromide cubic grain emulsions in accordance with the invention provides optimized speed, contrast and low intensity efficiency.

DESCRIPTION OF PREFERRED EMBODIMENTS

The silver halide grain emulsion of the invention comprises relatively large (equivalent circular diameters of greater than 0.6 micrometers, preferably from greater than 0.6 to 2.5 micrometers, more preferably from 0.7 to 2.0 micrometers and most preferably from 0.7 to 1.0 micrometers) cubic silver halide grains which, while predominantly comprising bromide, additionally comprise minor amounts of iodide and chloride. In particular, the emulsion grains comprise from 0.25 to about 1.5 mol % iodide (preferably from about 0.4 to about 1.3 mol % iodide, and more preferably from about 0.5 to about 1.0 mol % iodide), from 1 to about 25 mol % chloride (preferably from about 5 to about 20 mol % chloride, and more preferably from about 7 to about 20 mol % chloride), and from about 73.5 to 98.75 mol % bromide, based on total silver in the emulsion. The critical amount of iodide in combination with the relatively large grain size provides desired photographic speed, and the critical amount of chloride provides desired image tone and rapid processability. Higher levels of iodide negatively impact processability, and for higher chloride levels it becomes extremely difficult to maintain good cubicity and grain monodispersity for emulsions grain sizes of greater than 0.6 micrometers. Higher chloride percentages may also result in poor absorption of spectral sensitizing dyes to the grains where spectral sensitization is desired Silver iodochlorobromide grain emulsions in accordance with the invention additionally comprise a doped internal region of the grains formed after 10 percent and before 95 percent of the total grain silver has been precipitated, which contains a hexacoordination complex dopant of Formula (I):

$$[ML_6]^n \quad (I)$$

where n is zero, −1, −2, −3 or −4 (preferably −2, −3, or −4, and more preferably-3 or −4); M is a filled frontier orbital polyvalent metal ion, other than iridium, preferably $Fe^{+2}$, $Ru^{+2}$, $Os^{+2}$, $Co^{+3}$, $Rh^{+}3$, $Pd^{+4}$ or $Pt^{+4}$, more preferably an iron, ruthenium or osmium ion, and most preferably a ruthenium ion; and $L_6$ represents six bridging ligands which can be independently selected, provided that least four of the ligands are anionic ligands and at least one (preferably at least 3 and optimally at least 4) of the ligands is a cyano ligand or a ligand more electronegative than a cyano ligand. Any remaining ligands can be selected from among various other bridging ligands, including aquo ligands, halide ligands (specifically, fluoride, chloride, bromide and iodide), cyanate ligands, thiocyanate ligands, selenocyanate ligands, tellurocyanate ligands, and azide ligands. Hexacoordinated transition metal complexes of Formula (I) which include at least 4 and more preferably six cyano ligands arc specifically preferred.

Illustrations of specifically contemplated Formula (I) hexacoordination complexes for inclusion in the high bromide grains of the invention are provided by Bell U.S. Pat. Nos. 5,474,888, 5,470,771 and 5,500,335, Olm et al U.S. Pat. No. 5,503,970 and Daubendiek et al U.S. Pat. Nos. 5,494,789 and 5,503,971, and Keevert et al U.S. Pat. No. 4,945,035, the disclosures of which are here incorporated by reference, as well as Murakami et al Japanese Patent Application Hei-2[1990]-249588, and *Research Disclosure* Item 36736, the disclosures of which are here incorporated by reference. Useful neutral and anionic organic ligands for dopant hexacoordination complexes are disclosed by Olm et al U.S. Pat. No. 5,360,712 and Kuromoto et al U.S. Pat. No. 5,462,849, the disclosures of which are here incorporated by reference.

The following are specific illustrations of Formula (I) dopants:

| | |
|---|---|
| (I-1) | $[Fe(CN)_6]^{-4}$ |
| (I-2) | $[Ru(CN)_6]^{-4}$ |
| (I-3) | $[Os(CN)_6]^{-4}$ |
| (I-4) | $[Rh(CN)_6]^{-3}$ |
| (I-5) | $[Co(CN)_6]^{-3}$ |
| (I-6) | $[Fe(pyrazine)(CN)_5]^{-3}$ |
| (I-7) | $[RuCl(CN)_5]^{-4}$ |
| (I-8) | $[OsBr(CN)_5]^{-4}$ |
| (I-9) | $[RhF(CN)_5]^{-3}$ |
| (I-10) | $[In(NCS)_6]^{-3}$ |
| (I-11) | $[FeCO(CN)_5]^{-3}$ |
| (I-12) | $[RuF_2(CN)_4]^{-4}$ |
| (I-13) | $[OsCl_2(CN)_4]^{-4}$ |
| (I-14) | $[RhI_2(CN)_4]^{-3}$ |
| (I-15) | $[Ga(NCS)_6]^{-3}$ |
| (I-16) | $[Ru(CN)_5(OCN)]^{-4}$ |
| (I-17) | $[Ru(CN)_5(N_3)]^{-4}$ |
| (I-18) | $[Os(CN)_5(SCN)]^{-4}$ |
| (I-19) | $[Rh(CN)_5(SeCN)]^{-3}$ |
| (I-20) | $[Os(CN)Cl_5]^{-4}$ |
| (I-21) | $[Fe(CN)_3Cl_3]^{-4}$ |
| (I-22) | $[Ru(CO)_2(CN)_4]^{-2}$ |

When the Formula (1) dopants have a net negative charge, it is appreciated that they are associated with a counter ion when added to the reaction vessel during precipitation. The counter ion is of little importance, since it is ionically dissociated from the dopant in solution and is not incorporated within the grain. Common counter ions known to be fully compatible with silver chloride precipitation, such as ammonium and alkali metal ions, are contemplated. It is noted that the same comments apply to iridium dopants also employed in accordance with the invention, otherwise described below.

In accordance with the invention, the dopant of Formula (I) is contained in a dopant band within the central portion of the emulsion grains formed after 10 percent and before 95 percent of the total grain silver has been precipitated. Inclusion of the dopant in the first 10 percent of precipitation has been found to lead to excessive speed loss, while positioning of the dopant in the outermost 5 percent of precipitation may result in the dopant being present at the grain surface and desensitizing the grain: Emulsions demonstrating the advantages of the invention can be realized by modifying the precipitation of conventional high bromide silver halide cubic grains to obtain grains incorporating the dopant. To be located within an internal band, the dopant should be introduced (either by separate jet or by a common jet) into a silver halide reaction vessel during precipitation of at least a part of the central portion of the emulsion grains. The dopants are preferably introduced into the high bromide silver iodochlorobromide grains after at least 30 (more preferably after 50 and most preferably after 70) percent of the silver has been precipitated for such grains, but before precipitation of the central portion of the grains has been completed. Preferably, the dopant is introduced before 90 (more preferably before 85) percent of the silver has been precipitated. Stated in terms of the fully precipitated grain structure, the dopant of Formula (I) is present in an interior shell region that surrounds at least 10 (preferably at least 30, more preferably at least 50 and most preferably at least 70) percent of the silver and, with the more centrally located silver, accounts for 95 percent of the silver, more preferably 90 percent and most preferably for 85 percent. In a particularly preferred embodiment, the dopant is introduced during formation of a dopant band from 75–80 percent of silver precipitation.

The Formula (I) coordination complex dopant can be employed in any useful concentration. The silver halide grains preferably contain from $10^{-7}$ to $10^{-3}$ mole (more preferably from $10^{-6}$ to $5\times10^{-4}$ mole, and most preferably from $10^{-5}$ to $2\times10^{-4}$ mole) of a dopant of Formula (I), per total mole of silver.

Formation of silver halide emulsions typically involves a crystal nuclei-forming step wherein addition of silver ion to a reaction vessel results primarily in the precipitation of new crystal nuclei, and a subsequent growth step wherein the rate at which silver and halide are introduced is controlled to primarily grow the crystals already previously formed. The emulsions of the invention can be obtained by modifying conventional methods for preparing relatively large size high bromide cubic grain emulsions, wherein a dopant of Formula (I) is added during precipitation of a portion thereof after formation of a host grain population. Any convenient conventional silver halide grain precipitation procedure may be employed to form the host grain population, which in accordance with the invention accounts for at least 10 mole percent (preferably at least 30 mole percent, more preferably at least 50 mole percent) of total silver of the final emulsion to be formed. The host grain emulsions can have any halide concentrations consistent with overall composition requirements of the grains of the invention. The host grains are preferably cubic, but can include other cubical forms, such as tetradecahedral forms. Once a host grain population has been prepared which will account for at least 10 mole percent of total silver of the final emulsion, a dopant of Formula (I) is added during at least a portion of subsequent grain growth prior to formation of the final 5 mole percent of total silver precipitation. Where the reaction vessel contains excess halide ions, the silver salt solution may be added by itself to precipitate the outer shell. It is preferred, however, to simultaneously introduce a halide salt solution into the dispersing medium with the silver salt solution. Bromide salt may be added as the halide salt, either alone or in combination with chloride or iodide salts consistent with the overall composition requirements of the grains to be formed. Formation of cubic grains during grain growth may be favored by controlling the relative silver and halide ion solution concentrations as well known in the art (e.g., maintaining pAg at 8.10 or less, preferably 7.80 or less and more preferably 7.60 or less). In accordance with a particular embodiment, the emulsions of the invention have surprisingly been found to provide cubic silver iodochlorobromide emulsion grains of high "cubicity", especially for relatively large grain emulsions, as demonstrated by the preparation of emulsions comprising cubic grains having low average roundness index. Such high cubicity grain emulsions have been found to provide improvements with respect to higher contrast, lower fog, and higher maximum densities when employed in photographic elements, particularly for radiographic photographic elements designed for rapid access processing.

In the simplest form of silver halide grain preparation in accordance with the invention, nucleation and growth stages may occur in the same reaction vessel. Two or more separate reaction vessels can be substituted for the single reaction vessel, however. Nucleation and initial growth of seed grains can be performed in an upstream reaction vessel, e.g., and the dispersed grain nuclei can be transferred to a downstream reaction vessel in which the subsequent shell growth step occurs. Arrangements which separate grain nucleation from grain growth, e.g., are disclosed by Mignot U.S. Pat. No. 4,334,012 (which also discloses the useful feature of ultrafiltration during grain growth); Urabe U.S. Pat. No. 4,879,208 and published European Patent Applications 326, 852; 326,853; 355,535 and 370,116, Ichizo published European Patent Application 0 368 275; Urabe et al published European Patent Application 0 374 954; and Onishi et at published Japanese Patent Application (Kokai) 172,817-A (1990).

Precipitation of silver halide grains typically is performed in the presence of a gelatino-peptizer. The performance improvements described in accordance with the invention may be obtained for silver halide grains employing conventional gelatino-peptizer, as well as oxidized gelatin (e.g., gelatin having less than 30 micromoles of methionine per gram). Accordingly, in specific embodiments of the invention, it is specifically contemplated to use significant levels (i.e., greater than 1 weight percent of total peptizer) of conventional gelatin (e.g., gelatin having at least 30 micromoles of methionine per gram) as a gelatino-peptizer for the silver halide grains of the emulsions of the invention.

Once high bromide cubic silver iodochlorobromide grains have been precipitated as described above, chemical and spectral sensitization, followed by the addition of conventional addenda to adapt the emulsion for the imaging application of choice can take any convenient conventional form. These conventional features are illustrated by *Research Disclosure*, Item 38957, cited above, particularly:

| | |
|---|---|
| III. | Emulsion washing; |
| IV. | Chemical sensitization; |
| V. | Spectral sensitization and desensitization; |
| VII. | Antifoggants and stabilizers; |
| VIII. | Absorbing and scattering materials; |
| IX. | Coating and physical property modifying addenda; and |
| X. | Dye image formers and modifiers. |

Some additional silver halide, generally less than 5 percent and typically less than 1 percent, based on total silver, can be introduced to facilitate chemical sensitization. It is also recognized that silver halide can be epitaxially deposited at selected sites on a host grain to increase its sensitivity. For the purpose of providing a clear demarcation, the term "silver halide grain" is herein employed to include the silver necessary to form the grain up to the point that the final major {100} crystal faces of the cubic grain are formed. Silver halide later deposited that does not overlie the major crystal faces previously formed accounting for at least 50 percent of the grain surface area is excluded in determining total silver forming the silver halide grains. Thus, silver forming selected site epitaxy is not part of the silver halide grains while silver halide that deposits and provides the final major crystal faces of the grains is included in the total silver forming the grains, even when it differs significantly in composition from the previously precipitated silver halide.

The emulsions of the invention maybe chemically sensitized as known in the art. Preferred chemical sensitizers include gold and sulfur chemical sensitizers. Typical of suitable gold and sulfur sensitizers are those set forth in Section IV of *Research Disclosure* 38957, September 1996. Preferred is colloid aurous sulfide such as disclosed in *Research Disclosure* 37154 for good speed and low fog. It is also possible to add dopants during emulsion finishing.

The emulsions can be spectrally sensitized in any convenient conventional manner. Spectral sensitization and the selection of spectral sensitizing dyes is disclosed, for example, in *Research Disclosure*, Item 38957, cited above, Section V. Spectral sensitization and desensitization. The emulsions used in the invention can be spectrally sensitized with dyes from a variety of classes, including the polymethine dye class, which includes the cyanines, merocyanines, complex cyanines and merocyanines (i.e., tri-, tetra- and polynuclear cyanines and merocyanines), styryls, merostyryls, streptocyanines, hemicyanines, arylidenes, allopolar cyanines and enamine cyanines. Combinations of spectral sensitizing dyes can be used which result in supersensitization—that is, spectral sensitization greater in some spectral region than that from any concentration of one of the dyes alone or that which would result from the additive effect of the dyes. Supersensitization can be achieved with selected combinations of spectral sensitizing dyes and other addenda such as stabilizers and antifoggants, development accelerators or inhibitors, coating aids, brighteners and antistatic agents. Any one of several mechanisms, as well as compounds which can be responsible for supersensitization, are discussed by Gilman, *Photographic Science and Engineering*, Vol. 18, 1974, pp. 418–430.

Silver halide emulsions are preferably protected against changes in fog upon aging. Preferred antifoggants can be selected from among the following groups:

A. A mercapto heterocyclic nitrogen compound containing a mercapto group bonded to a carbon atom which is linked to an adjacent nitrogen atom in a heterocyclic ring system, B. A quaternary aromatic chalcogenazolium salt wherein the chalcogen is sulfur, selenium or tellurium, C. A triazole or tetrazole containing an ionizable hydrogen bonded to a nitrogen atom in a heterocyclic ring system, or D. A dichalcogenide compound comprising an -X-X- linkage between carbon atoms wherein each X is divalent sulfur, selenium or tellurium.

The above groups of antifoggants are known in the art, and are described in more detail, e.g., in U.S. Pat. No. 5,792,601, the disclosure of which is incorporated by reference herein.

In the simplest contemplated form a recording element in accordance with the invention can consist of a single emulsion layer satisfying the emulsion description provided above coated on a conventional support, such as those described in *Research Disclosure*, Item 38957, cited above, XVI. Supports. With a single emulsion layer unit a monochromatic image is obtained. It is, of course, recognized that the elements of the invention can include more than one emulsion. Where more than one emulsion is employed, such as in an element containing a blended emulsion layer or separate emulsion layer units, all of the emulsions can be high bromide silver halide emulsions as contemplated by this invention. Alternatively one or more distinct emulsions can be employed in combination with the emulsions of this invention. For example, a separate emulsion can be blended with an emulsion prepared according to the invention to satisfy specific imaging requirements. For example, emulsions of differing speed are conventionally blended to attain specific aim radiographic characteristics. Instead of blending emulsions, the same effect can usually be obtained by coating the emulsions that might be blended in separate layers. It is well known in the art that increased radiographic speed can be realized when faster and slower emulsions are coated in separate layers with the faster emulsion layer positioned to receiving exposing radiation first. When the slower emulsion layer is coated to receive exposing radiation first, the result is a higher contrast image. Specific illustrations are provided by *Research Disclosure*, Item 36544, cited above Section I. Emulsion grains and their preparation, Subsection E. Blends, layers and performance categories.

The emulsion layers as well as optional additional layers, such as overcoats and interlayers, contain processing solution permeable vehicles and vehicle modifying addenda. Typically these layer or layers contain a hydrophilic colloid, such as gelatin or a gelatin derivative, modified by the addition of a hardener. Illustrations of these types of materials are contained in *Research Disclosure*, Item 36544, previously cited, Section II. Vehicles, vehicle extenders, vehicle-like addenda and vehicle related addenda. The overcoat and other layers of the photographic element can usefully include an ultraviolet absorber, as illustrated by *Research Disclosure*, Item 36544, Section VI. UV dyes/optical brighteners/luminescent dyes, paragraph (I). The overcoat, when present can usefully contain matting agents to reduce surface adhesion. Surfactants are commonly added to the coated layers to facilitate coating. Plasticizers and lubricants are commonly added to facilitate the physical handling properties of the photographic elements. Antistatic agents are commonly added to reduce electrostatic discharge. Illustrations of surfactants, plasticizers; lubricants and matting agents are contained in *Research Disclosure*, Item 36544, previously cited, Section IX. Coating physical property modifying addenda.

Once imagewise exposed, the recording elements can be processed in any convenient conventional manner to obtain a viewable image. Conventional processing is illustrated, e.g., by *Research Disclosure*, Item 38957, cited above:

| | |
|---|---|
| XVIII. | Chemical development systems |
| XIX. | Development |
| XX. | Desilvering, washing, rinsing and stabilizing |

A specific preferred application of the invention is in the preparation of high bromide emulsions for use in medical diagnostic imaging radiographic elements, particularly elements that arc sensitive to IR radiation. A number of varied photographic film constructions have been developed to satisfy the needs of medical diagnostic imaging. The common characteristics of these films is that they (I) produce viewable silver images having maximum densities of at least 3.0 and (2) are designed for rapid access processing.

Roentgen discovered X-radiation by the inadvertent exposure of a silver halide photographic clement. The discovery led to medical diagnostic imaging. In 1913, the Eastman Kodak Company introduced its first product specifically intended to be exposed by X-radiation. Shortly thereafter it was discovered that the films could be more efficiently employed in combination with one or two intensifying screens. An intensifying screen is relied upon to capture an image pattern of the X-radiation and emit light that exposes the radiographic element. Elements that rely entirely on X-radiation absorption for image capture are referred to as direct radiographic elements, while those that rely on intensifying screen light emission, are referred to as indirect radiographic elements. Silver halide radiographic elements, particularly indirect radiographic elements, account for the overwhelming majority of medical diagnostic images.

In recent years, a number of alternative approaches to medical diagnostic imaging, particularly image acquisition, have become prominent. Medical diagnostic devices such as storage phosphor screens, CAT scanners, magnetic resonance imagers (MRI), and ultrasound imagers allow information to be obtained and stored in digital form. Although digitally stored images can be viewed and manipulated on a cathode ray tube (CRT) monitor, a hard copy of the image is almost always needed.

The most common approach for creating a hard copy of a digitally stored image is to expose a radiation-sensitive silver halide film through a series of laterally offset exposures using a laser, a light-emitting diode (LED) or a light bar (a linear series of independently addressable LED's). The image is recreated as a series of laterally offset pixels. Initially, the radiation-sensitive silver halide films were essentially the same films used for radiographic imaging, except that finer silver halide grains were substituted to minimize noise (granularity). The advantages of using modified radiographic films to provide a hard copy of the digitally stored image are that medical imaging centers are already equipped for rapid access processing of radiographic films and are familiar with their image characteristics.

Rapid access processing can be illustrated by reference to the Kodak X-OMAT 480 RA™ rapid access processor, which employs the following (reference) processing cycle: development 24 seconds at 35° C.; fixing 20 seconds at 35° C.; washing 20 seconds at 35° C.; drying 20 seconds at 65° C.; with up to 6 seconds being taken up in film transport between processing steps.

A typical developer employed in this processor exhibits the following composition:

hydroquinone 30 g 1-phenyl-3-pyrazolidone 1.5 g

KOH 21 g
$NaHCO_3$ 7.5 g
$K_2SO_3$ 44.2 g
$Na_2S_2O_3$ 12.6 g
NaBr 35.0 g
5-methylbenzotriazole 0.06 g
glutaraldehyde 4.9 g
water to 1 liter at a pH 10.

A typical fixer employed in this processor exhibits the following composition:

$Na_2S_2O_3$ in water at 60% of total weight
in water 260.0 g
$NaHSO_3$ 180.0 g
boric acid 25.0 g
acetic acid 10.0 g
water to 1 liter at a pH of 3.9–4.5.

Numerous variations of the reference processing cycle (including, shorter processing times and varied developer and fixer compositions) are known.

Rapid access processors are typically activated when an imagewise exposed element is introduced for processing. Silver halide grains in the element interrupt an infrared sensor beam in the wavelength range of from 850 to 1 100 nm, typically generated by a photodiode. The silver halide grains reduce density of infrared radiation reaching a photosensor, telling the processor that an element has been introduced for processing and starting the rapid access processing cycle. Once silver halide grains have been developed, developed silver provides the optical density necessary to interact with the infrared sensors. When the processed element emerges from the processor, an infrared sensor placed near the exit of the processor receives an uninterrupted infrared beam and shuts down the processor until another element is introduced requiring processing.

The performance of radiographic films designed for such rapid access processing can be improved with use of high bromide silver halide cubic grain emulsions of the invention. Each emulsion layer unit of such films can contain one, two, three or more separate emulsion layers sensitized to the same regions of the spectrum. When more than one emulsion layer is present in the same emulsion layer unit, the emulsion layers typically differ in speed. Typically interlayers containing oxidized developing agent scavengers, such as ballasted hydroquinones or aminophenols, are interposed between the emulsion layer units to avoid color contamination: Ultraviolet absorbers are also commonly coated over the emulsion layer units or in the interlayers.

Silver halide emulsions satisfying the grain requirements described above can be present in any one or combination of emulsion layer units in a radiographic film element, wherein such emulsion layer units are employed in any convenient conventional sequence. The advantages of the current invention may be achieved by modifying any or all of the emulsion formulations of such conventional sequences to conform to the requirements set forth in the specification. The exact magnitude of the benefits achieved will, of course, depend on the exact details of the formulations involved but these will be readily apparent to the skilled practitioner. It is specifically contemplated, e.g., that the emulsions of the invention will be useful in radiographic photographic elements intended for rapid processing such as described in U.S. Pat. Nos. 5,089,379 and 5,981,161, the disclosures of which are incorporated by reference herein, in combination with the various specific useful sensitizing dyes, surface active agents, azaindene compound and dopants such as described therein.

The following examples illustrate the practice of this invention. They are not intended to be exhaustive of all possible variations of the invention. Parts and percentages are by weight unless otherwise specified.

EXAMPLES

The invention can be better appreciated by consideration in conjunction with the specific embodiments. The notation (C) is employed to designate comparative emulsions while the notation (E) is employed to designate emulsions that are examples of the inventive emulsions. Speeds are reported as relative log speeds—e.g. 30 speed units=0.30 log E, where E is exposure in lux-seconds.

Example 1

Preparation of Emulsions 1.1–1.8

A series of emulsions were prepared, which were highly cubic (roundness index Q of less than 0.2), with average equivalent circular diameters of 0.85 micrometer.

Emulsion 1.1 (C)

To 4.5 liters of an 7.9% solution of gelatin, which contains 1.8 g of a polyethyleneglycoldiolxata antifoamant agent and 0.94 g of 2,2'-(1,2 ethanediylbis(thio))bis-ethanol ripener in demineralized water which is adjusted to a vAg of 60 mv., a 2.86M solution of $AgNO_3$ was added at a rate of 9 cc/min for 3 min. vAg was controlled with 2.86M NaBr, using the double-jet method of precipitation. Temperature for the whole precipitation was controlled at 70° C. During the next 4.5 min. segment the vAg was ramped up to 120 mv. with the $AgNO_3$ flow rate still at 9 cc/min. For the next 69.8 minutes the $AgNO_3$ flow rate was ramped up from 9 cc/min to 71.84 cc/min and the vAg was controlled using a 2.86M solution made up I:Cl:Br (1:10:89 mol %).

Emulsions 1.2(E)–1.4(E)

Emulsion 1.2(E) was prepared like Emulsion 1.1, except between the 75% and 80% mark of the make (by moles), sufficient $K_4Ru(CN)_6$ is added to the emulsion so as to provide a concentration of Ru equal to 10 ppm ($\mu$g Ru/g AgX), which corresponds to a concentration of $2\times10^{-5}$ mole per silver mole of the coordination complex dopant. Likewise, emulsions 1.3(E) and 1.4(E) were prepared with 25 and 50 ppm Ru, respectively.

Emulsions 1.5(C) and 1.6(E)–1.8(E)

These emulsions were prepared in an analogous manner to emulsions 1.1–1.4, respectively, except that the I:Cl:Br halide mol ratio was 1:20:79.

The emulsions were adjusted to pH 4.0 and sensitized with (per Ag mole); 25mg NaSCN, 200mg dye SD-1 (KAN 226714, Benzoxazolium, 2-(3-(5,6-dichloro-1-ethyl-1,3-dihydro-3-(4-sulfobutyl)-2H-benzim idazol-2-ylidene)-1-propenyl)-3-ethyl-, inner salt), 1.4 mg aurous dithiosulfate dihydrate, 0.2 mg KSeCN and heated from 40 to 65 C at a rate of 1.667 C/min, held at 65 C for 12 min, then ramped down to 40° C. at the same rate.

SD-1

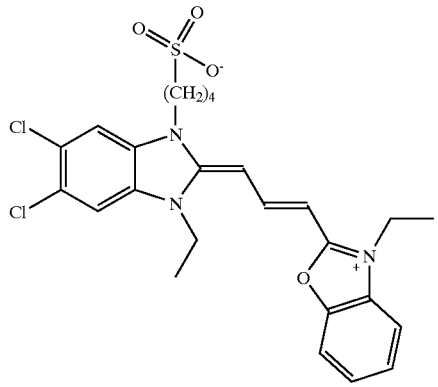

The emulsions were coated on blue tinted 7mil poly (ethylene terephthalate) support at a Ag laydown of 4.3 g/sq.m in 3.2 g/sq.m gel and 19 mg/sq.m NaBr, 40 mg/sq.m 4-Hydroxy-6-methyl-1,3,3a,7-tetraazaindene (TAI), 590 mg/sq.m 3,5-disulfocatechol, 27 mg/sq.m glycerol, 330 mg/sq.m butyl acrylate latex, 1 mg/sq.m maleic acid hydrazide, 0.04 mg/sq.m sodium hydroxide and 290 mg/sq.m of resorcinol.

This emulsion layer was overcoated with 0.72 g/sq.m gel containing 21 mg/sq.m poly(styrenesulfonic acid), 34 mg/sq.m poly(methylmethacrylate) matte beads, 0.27 g/sq.m colloidal silica, 15 mg/sq.m resorcinol and 29 mg/sq.m TAI. 0.48% wrt gel of bis(vinylsulfonylmethane) was mixed into the overcoat solution at the time of coating.

Coatings were given 0.5 sec step tablet exposures at 546nm using a mercury vapor lamp and an interference filter to isolate the 546 run emission line. Coatings were also exposed at lower-intensity, longer exposure time (10 second), where the total energy of each exposure was kept at a constant level. Standard RP XOMAT processing was performed on exposed samples.

TABLE 1

| Emulsion | I/Cl/Br mol % | Ru (ppm) | 1.0 Spd | 1.0 γ | 0.2 γ | Δ Spd |
|---|---|---|---|---|---|---|
| 1.1(C) | 1/10/89 | 0 | 197 | 3.61 | 1.05 | 18 |
| 1.2(E) | " | 10 | 192 | 3.87 | 1.11 | 18 |
| 1.3(E) | " | 25 | 184 | 3.93 | 1.21 | 16 |
| 1.4(E) | " | 50 | 169 | 3.96 | 1.30 | 9 |
| 1.5(C) | 1/20/79 | 0 | 185 | 4.01 | 0.95 | 29 |
| 1.6(E) | " | 10 | 196 | 3.81 | 1.00 | 16 |
| 1.7(E) | " | 25 | 187 | 4.11 | 1.22 | 16 |
| 1.8(E) | " | 50 | 178 | 4.83 | 1.11 | 14 |

In Table 1, 1.0 Spd denotes speed at a density of 1.0 above fog, and 1.0 γ& 0.2 γ are the contrast values at 1.0 and 0.2 density above fog respectively for the 0.5 sec exposures. Δ Spd is the speed loss in going from a 0.5 see to a 10 see exposure. As can be seen, while shallow electron trapping dopants are generally regarded as speed increasing dopants, progressive addition of $Ru(CN)_6$ surprisingly increases contrast throughout the sensitometric curve for the relatively large silver iodochlorobromide grain emulsions of the invention, with some associated speed loss and significant improvements in low intensity reciprocity failure.

Example 2

Preparation of Emulsions 2.1–2.6

A series of emulsions were prepared in a manner analogous to Emulsion 1, but with an I:Cl:Br halide mol ratio of 0.5:13.2:86.3. The emulsion grains were highly cubic (roundness index Q of less than 0.2), with average equivalent circular diameters of 0.73 μm.

The emulsions were adjusted to pH 4.0 and sensitized with (per Ag mole); 25mg NaSCN, 180 mg dye SD-2 (Benzoxazolium, 5-chloro-2-(2-((5-chloro-3-(3-sulfopropyl)-2(3H)-benzoxazolyliden e)methyl)-1-butenyl)-3-(3-sulfopropyl)-, inner salt, sodium salt), 1 80mg dye SD-3 (Benzoxazolium, 5-chloro-2-(3-(5,6-dichloro-1-ethyl-1,3-dihydro-3-(4sulfobutyl)-2H-benzim idazol-2-ylidene)-1-propenyl)-3-(3-sulfopropyly-, inner salt, 1,8-diazabicyclo [5.4.0]undec-7-ene salt), 1.4 mg aurous dithiosulfate dihydrate, 0.2 mg KScCN and heated from 40 to 65 C at a rate of 1.667 C/min, held at 65 C for 12 min, then ramped down to 40 C at the same rate.

SD-2

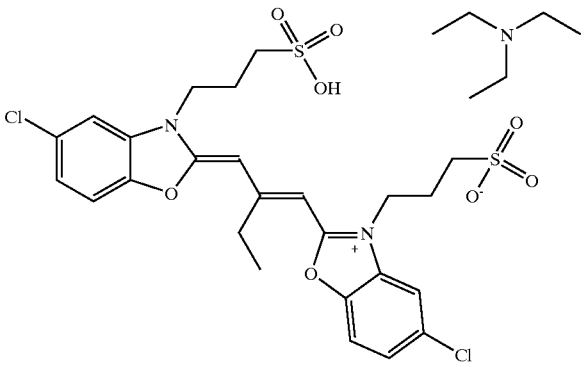

SD-3

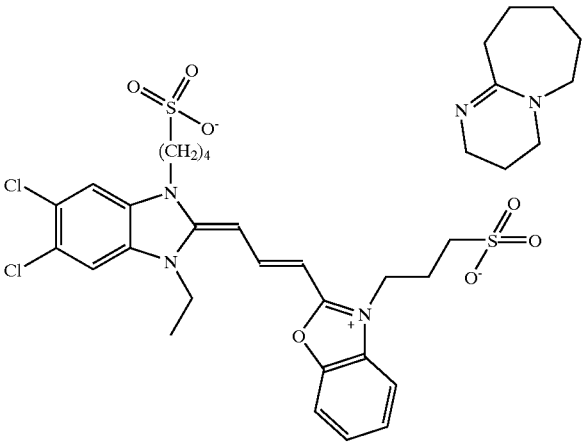

Emulsion 2.1(C) contained no Ruthenium dopant, while Emulsions 2.2(E)–2.6(E) each contained 31 ppm Ru, which corresponds to a concentration of $5.6\times10^{-5}$ mole per silver mole of the coordination complex dopant, with placement of the $K_4Ru(CN)_6$ being varied. In each case, the dopant was added during the growth of a 5 mol % band of the total silver halide. The placement of this band ranged from near the surface to near the core of the emulsion.

TABLE 2

| Emulsion | Br/Cl/I % | Ru (ppm) | Ru Placement | 1.0 Spd | 1.0 γ | 0.2 γ | Δ Spd |
|---|---|---|---|---|---|---|---|
| 2.1(C) | 86.3/13.2/0.5 | 0 | None | 177 | 3.98 | 1.14 | 17 |
| 2.2(E) | 86.3/13.2/0.5 | 31 | 75–80% | 172 | 4.25 | 1.33 | 10 |
| 2.3(E) | 86.3/13.2/0.5 | 31 | 65–70% | 168 | 4.28 | 1.32 | 9 |
| 2.4(E) | 86.3/13.2/0.5 | 31 | 55–60% | 169 | 4.22 | 1.36 | 10 |
| 2.5(E) | 86.3/13.2/0.5 | 31 | 35–40% | 165 | 4.39 | 1.35 | 9 |
| 2.6(E) | 86.3/13.2/0.5 | 31 | 0.4–5.4% | 148 | 5.57 | 1.71 | 7 |

As can be seen in Table 2, the optimal placement of the Ru hexacoordination complex dopant so as to enable high contrast, good reciprocity, and minimal loss in speed is in the outer portion of the emulsion grains, preferably after 30 percent of silver has been precipitated, more preferably after 50 percent of silver has been precipitated, and most preferably after 70 percent of silver has been precipitated, with placement of the dopant in a band from 75–80% of the precipitation being particularly preferred.

The invention has been described in detail with particular reference to preferred embodiments thereof, but it will be understood that variations and modifications can be effected within the spirit and scope of the invention.

What is claimed is:

1. A radiation-sensitive silver halide emulsion comprised of cubic silver iodochlorobromide grains comprising 0.25 to about 1.5 mol % iodide, 1 to about 25 mol % chloride, and from about 73.5 to 98.75 mol % bromide, each based on total silver in the emulsion, wherein the grains have an average equivalent circular diameter of greater than 0.6 micrometers and contain from $10^{-7}$ to $10^{-3}$ mole per silver mole of a metal ion coordination complex dopant of Formula (I) in an internal region of the grains formed after 10 percent and before 95 percent of the total grain silver has been precipitated:

$$[ML_6]^n \quad \text{(I)}$$

wherein n is zero, −1, −2, −3 or −4,

M is a filled frontier orbital polyvalent metal ion, other than iridium, and $L_6$ represents bridging ligands which can be independently selected, provided that at least four of the ligands are anionic ligands, and at least one of the ligands is a cyano ligand or a ligand more electronegative than a cyano ligand.

2. An emulsion according to claim 1, wherein the silver iodochlorobromide grains comprise from about 0.4 to about 1.3 mol % iodide based on total silver in the emulsion.

3. An emulsion according to claim 1, wherein the silver iodochlorobromide grains comprise from about 0.5 to about 1.0 mol % iodide based on total silver in the emulsion.

4. An emulsion according to claim 1, wherein the silver iodochlorobromide grains comprise from 5 to about 20 mol % chloride based on total silver in the emulsion.

5. An emulsion according to claim 1, wherein the silver iodochlorobromide grains comprise from about 7 to about 20 mol % chloride based on total silver in the emulsion.

6. An emulsion according to claim 1, wherein the silver iodochlorobromide grains comprise from about 0.4 to about 1.3 mol % iodide, from 5 to about 20 mol % chloride, and from about 78.7 to 94.6 mol % bromide, each based on total silver in the emulsion.

7. An emulsion according to claim 1, wherein the silver iodochlorobromide grains comprise from about 0.5 to about 1.0 mol % iodide, from about 7 to about 20 mol % chloride, and from about 79 to about 92.5 mol % bromide, each based on total silver in the emulsion.

8. An emulsion according to claim 1, wherein the coordination complex dopant is located in an internal region of the grains formed after 30 percent and before 95 percent of the total grain silver has been precipitated.

9. An emulsion according to claim 1, wherein the coordination complex dopant is located in an internal region of the grains formed after 50 percent and before 95 percent of the total grain silver has been precipitated.

10. An emulsion according to claim 1, wherein the coordination complex dopant is located in an internal region of the grains formed after 70 percent and before 95 percent of the total grain silver has been precipitated.

11. An emulsion according to claim 1, wherein the coordination complex dopant is located in a dopant band formed from 75 percent to 80 percent of the total grain silver precipitation.

12. An emulsion according to claim 1, wherein the grains contain from $10^{-6}$ to $5\times10^{-4}$ mole per silver mole of the coordination complex dopant.

13. An emulsion according to claim 1, wherein the grains contain from $10^{-5}$ to $2\times10^{-4}$ mole per silver mole of the coordination complex dopant.

14. An emulsion according to claim 1 wherein M represents an $Fe^{+2}$, $Ru^{+2}$, $Os^{+2}$, $Co^{+3}$, $Rh^{+3}$, $Pd^{+4}$, or $Pt^{+4}$ ion.

15. An emulsion according to claim 1 wherein M represents an iron, ruthenium or osmium ion.

16. An emulsion according to claim 1 wherein M represents a ruthenium ion.

17. An emulsion according to claim 1 wherein each of the bridging ligands of the dopant of Formula (I) are at least as electronegative as cyano ligands.

18. An emulsion according to claim 17 wherein M represents a ruthenium ion.

19. An emulsion according to claim 18 wherein the dopant is $[Ru(CN)_6]^{-4}$.

20. An emulsion according to claim 1, wherein the cubic silver iodochlorobromide grains have an average roundness index Q of less than 0.2.

21. A photographic recording element comprising a support bearing at least one radiation-sensitive silver halide emulsion layer comprising an emulsion according to claim 1.

* * * * *